US008499373B2

(12) United States Patent
Saviano

(10) Patent No.: US 8,499,373 B2
(45) Date of Patent: Aug. 6, 2013

(54) ANCHOR ARRANGEMENT FOR SWIMMING POOL

(75) Inventor: Joseph C. Saviano, Delton, MI (US)

(73) Assignee: Swimsmith Co., Delton, MI (US)

( * ) Notice: Subject to any disclaimer, the term of this patent is extended or adjusted under 35 U.S.C. 154(b) by 279 days.

(21) Appl. No.: 13/068,006

(22) Filed: Apr. 29, 2011

(65) Prior Publication Data

US 2011/0265420 A1 Nov. 3, 2011

Related U.S. Application Data

(60) Provisional application No. 61/343,446, filed on Apr. 29, 2010.

(51) Int. Cl.
*E04H 4/00* (2006.01)

(52) U.S. Cl.
USPC ..... 4/496; 52/298; 52/741.15

(58) Field of Classification Search
USPC ..... 4/496; 52/297, 298, 741.15; 248/346.01
See application file for complete search history.

(56) References Cited

U.S. PATENT DOCUMENTS 3,090,489 A * 5/1963 Smith ..... 4/496
7,694,487 B1 * 4/2010 Ryan ..... 52/741.15
7,954,289 B2 * 6/2011 Evans ..... 52/298

* cited by examiner

*Primary Examiner* — Tuan N Nguyen
(74) *Attorney, Agent, or Firm* — Flynn, Thiel, Boutell & Tanis, P.C.

(57) ABSTRACT

An apparatus and kit for installing an object in a swimming pool are provided. Included are a receptacle, one or more gaskets, and a top deck anchor. The receptacle holds a substance such as concrete, to which the top deck anchor is attached. The gasket is attached to the top of the receptacle. A method of installing an object into a swimming pool is also provided.

18 Claims, 4 Drawing Sheets

ANCHOR ARRANGEMENT FOR SWIMMING POOL

CROSS-REFERENCE TO RELATED APPLICATION

This application claims the benefit of U.S. Provisional Application No. 61/343,446, filed Apr. 29, 2010, entitled ANCHOR ARRANGEMENT FOR SWIMMING POOL, the entire contents of which are hereby incorporated by reference.

FIELD OF THE INVENTION

The present invention generally relates to supports for objects in a swimming pool, and more specifically relates to anchors for posts in a swimming pool.

BACKGROUND OF THE INVENTION

Steel wall, vinyl liner swimming pools are common in both residential and commercial settings. In some such swimming pools, apparatus employing one or more poles or posts, such as for stools, are desired to be permanently installed inside the pool.

However, there are practical limitations for installing such a post in such a swimming pool due to the use of vinyl liners that cover the bottoms of such pools. A hole in the vinyl liner is necessarily created where the post is to be secured to the pool bottom. The creation of a hole in the vinyl liner will likely result in leakage of water between the vinyl liner and the pool bottom surface. In addition, the bottoms of such pools are typically composed of a vermiculite and cement (such as Portland cement) mixture, making it virtually impossible to securely install a post due to the lack of resilience and strength of the mixture. The post and its attachment will not withstand typical pool forces if the post is merely seated within the vermiculite/cement bottom, even if a fixture such as a wall fitting is used.

The anchor arrangement of one or more embodiments of the present invention allows a post, such as that for a stool or other accessory, to be installed securely into a concrete portion of a bottom of a swimming pool, while preventing leakage of water beneath the vinyl lining. One embodiment of the anchor arrangement includes a stabilizing vessel for insertion into a concrete portion of a swimming pool bottom, that is preferably in the shape of a large circular cup and has a circular top rim, and a plurality of concrete sets for insertion into concrete within the stabilizing vessel. A pair of seals, disposed to receive a vinyl liner between them, are attachable to the circular top rim of the stabilizing vessel by use of a top seal ring. A post is installed through and secured by a top deck anchor which is attached to the concrete sets and to which the post is secured by use of one or more fasteners.

Installation of such an anchor arrangement embodiment is not complex and results in a stabilized and secure post installation which prevents leakage between the vinyl liner and the pool bottom.

Other embodiments and features of the invention, and variations thereof, will be apparent upon reading the following specification and claims and inspecting the accompanying drawings.

Figure 1:
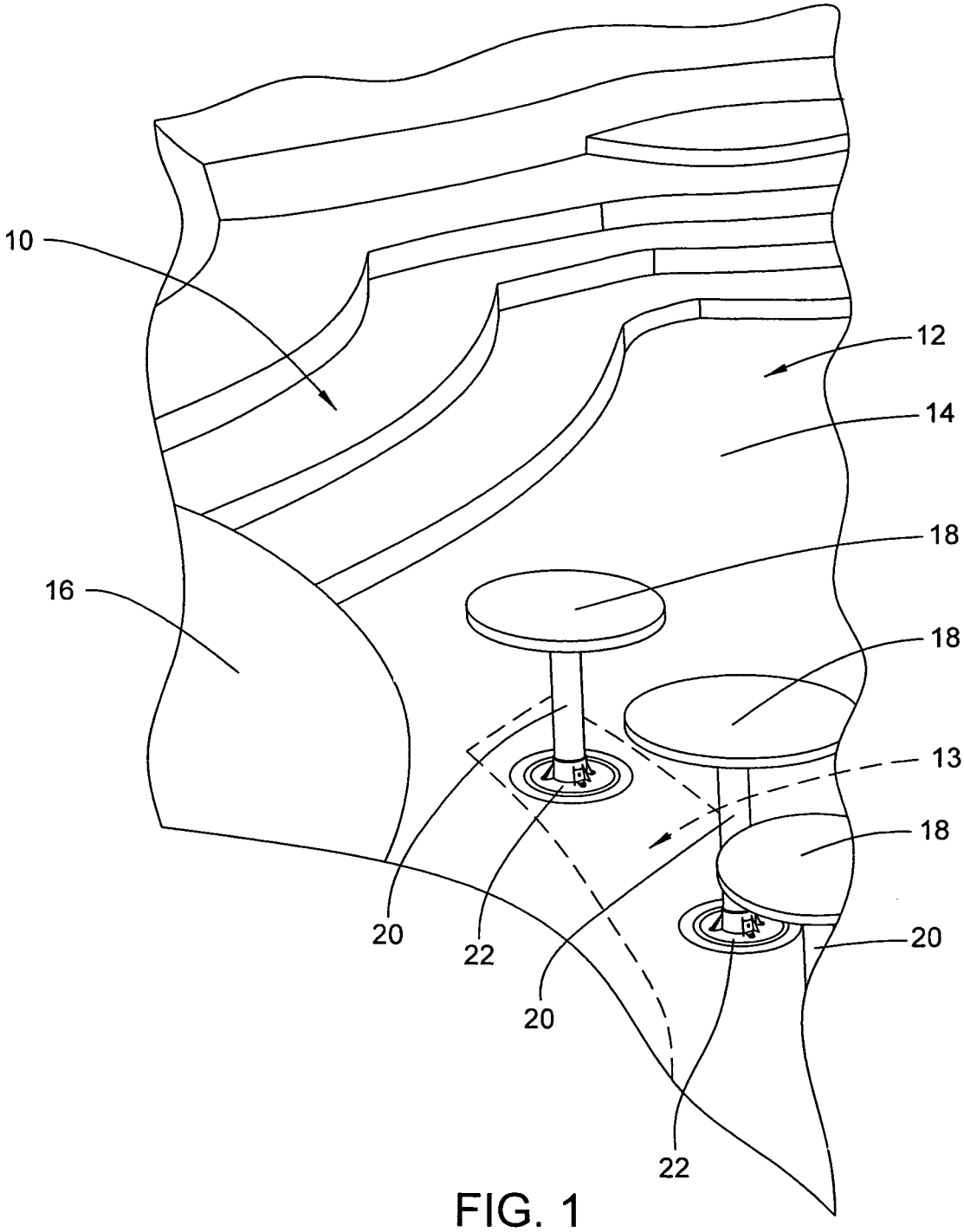
FIG. 1 is a top perspective view of a swimming pool having a plurality of sitting stools, each of which employs an embodiment of an anchor arrangement of the present invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the anchor arrangement and designated parts thereof. Said terminology will include the words specifically mentioned, derivatives thereof, and words of similar import.

DETAILED DESCRIPTION OF THE PREFERRED EMBODIMENT

Referring now to the drawing figures, FIG. 1 shows a portion of a swimming pool 10. The pool 10 includes a bottom 12, generally of a vermiculite/cement mixture and a strip of concrete 13 that is preferably about a foot deep. The bottom 12 is covered by a vinyl liner 14 that ensures that water remains in the pool. The pool 10 shown in FIG. 1 also includes a bar counter top 16 adjacent one side of the pool 10 for serving drinks or other entertainment. A plurality of stools 18 reside adjacent the bar counter top 16 in the pool 10. Stools 18 each include a support post 20 that is attached to the concrete strip 13 of the bottom 12 by an anchor arrangement 22.

Figure 2:
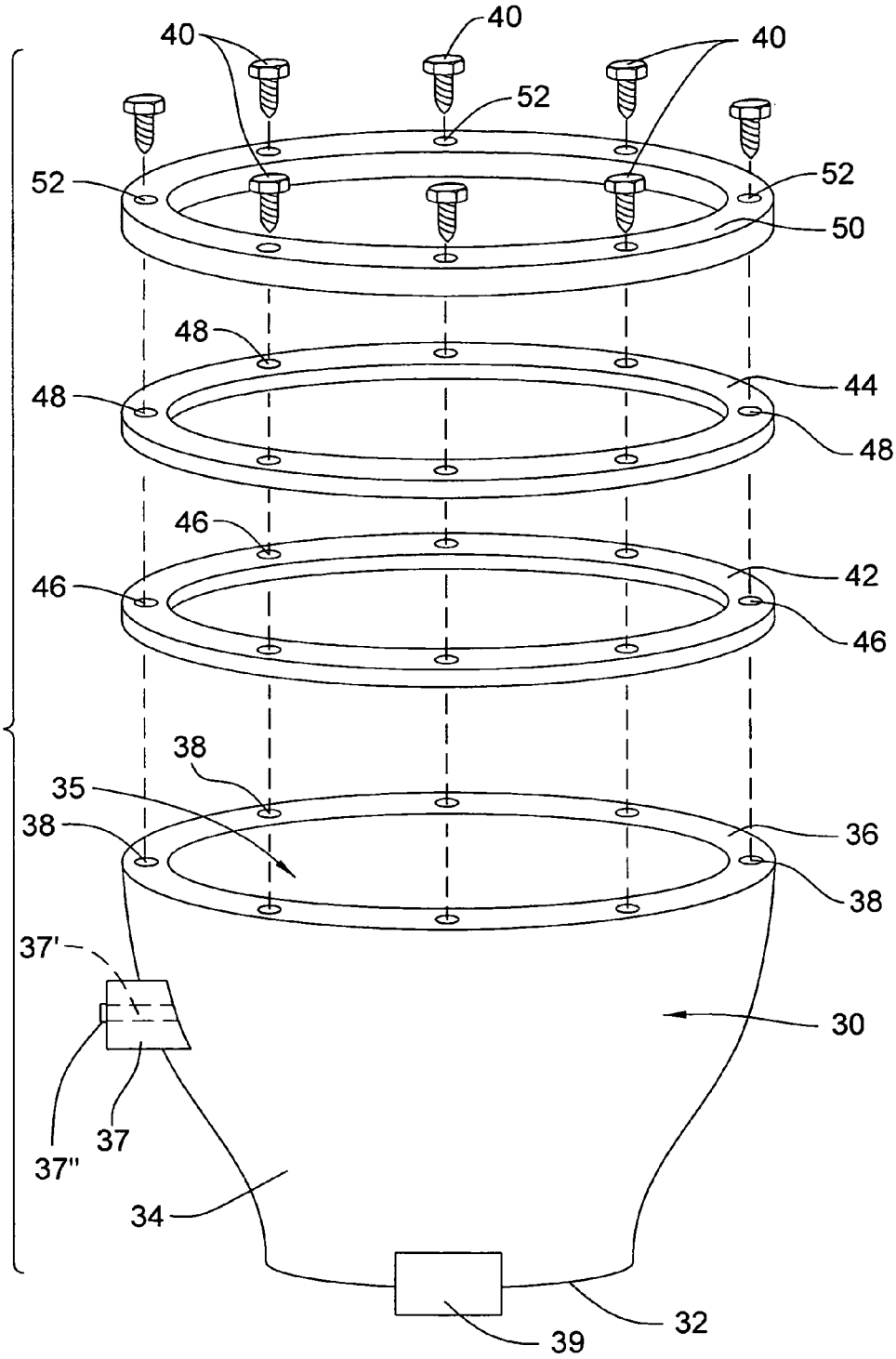
FIG. 2 is an exploded perspective view of a stabilizing vessel and seal arrangement of an embodiment of an anchor arrangement of the present invention.
Figure 3:
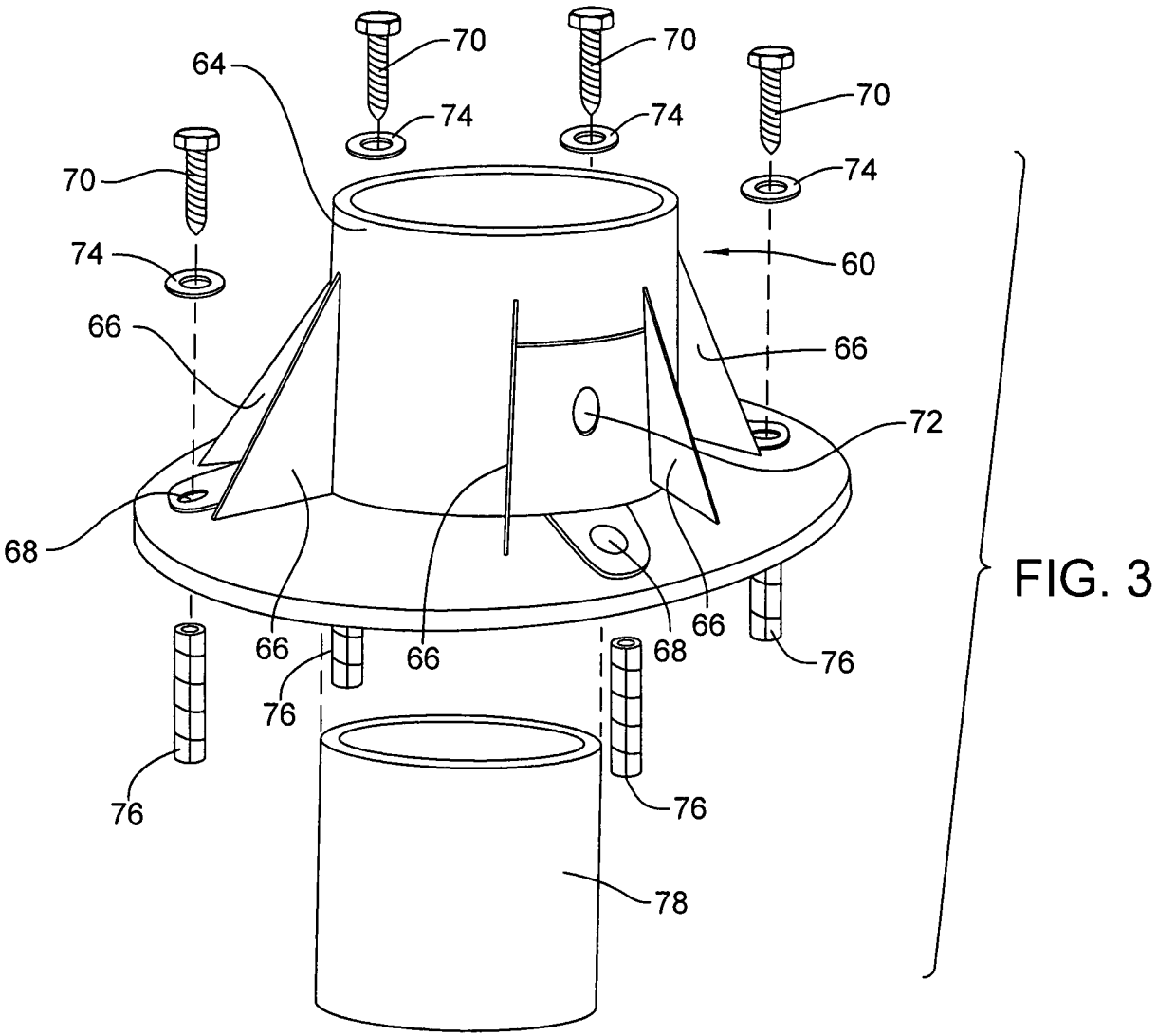
FIG. 3 is an exploded perspective view of a top deck anchor with concrete sets and screws, all of which are parts of an embodiment of an anchor arrangement of the present invention.

FIGS. 2-3 show components of the anchor arrangement 22. Referring to FIG. 2, the anchor arrangement 22 includes a stabilizing vessel 30. The stabilizing vessel 30 is cup-shaped and its inner diameter is preferably at least twice that of the diameter of a support post 20, a portion of which will reside within the inner diameter of the stabilizing vessel 30. The stabilizing vessel 30 has a bottom 32, which may or may not be flat and has a continuous wall 34 extending upwardly from the bottom 32. The bottom 32 and wall 34 define an interior 35. At its top, wall 34 terminates at a circular rim 36 which is preferably flat, i.e. in a single plane. Bored into and below the rim 36 are a plurality of holes 38, which are preferably equally spaced from one another, and which are sized and shaped to receive the threaded portion of a fastener 40 such as a screw or hex bolt. In the preferred embodiment, the stabilizing vessel has six holes 38. The stabilizing vessel 30 also preferably includes one or more cleats, which are protrusions from the outer edge of wall 34 or bottom 32 to assist in maintaining the position of the stabilizing vessel 30 in concrete when it is installed. The stabilizing vessel 30 shown in FIG. 2 includes two cleats, a side cleat 37 and a bottom cleat 39. The side cleat 37 includes an aperture 37' for receiving and threading of a bonding wire which is discussed below. A sealing nut 37" is used to seal the aperture 37' and thus the stabilizing vessel from water intrusion. The stabilizing vessel 30 is preferably made entirely of stainless steel, but other materials could be used alone or in combination with stainless steel. Other possible materials for manufacture of the stabilizing vessel include bronze and rigid moldable plastics.

The anchor arrangement 22 also includes a bottom gasket 42 and a top gasket 44, which are preferably identical to one another. The bottom gasket 42 and top gasket 44 have substantially the same inner diameter, and substantially the same outer diameter, as the rim 36 of the stabilizing vessel 30. Gaskets 42, 44 are preferably comprised of a pressed cork or a compressed paper substance. It is contemplated that gaskets of other suitable materials may also be used. An example of a gasket that may be used with the anchor arrangement 22 is the Model CS-301 gasket sold by Interface Solutions, Inc. of Lancaster, Pa. Bottom gasket 42 includes a plurality of holes 46 that align with, and preferably are the same in number as, the holes 38 of the stabilizing vessel 30 when the bottom gasket 42 is properly aligned with the rim 36 of stabilizing vessel 30. Similarly, top gasket 44 includes a plurality of holes 48 which align with, and preferably are the same in number as, the holes 46 of the bottom gasket 42 and the holes 38 of the stabilizing vessel 30 when aligned properly with both the bottom gasket 42 and the rim 36 of the stabilizing vessel 30.

The anchor arrangement 22 also includes a top cap 50, preferably in the form of a ring, for securing the vinyl liner 14 of the pool between the top gasket 44 and the bottom gasket 42 and securing the gaskets and liner to the stabilizing vessel 30, the procedure of which is discussed in more detail below. The top cap 50 is preferably of the same material as the stabilizing vessel 30 and includes a plurality of holes 52, preferably the same in number as the number of holes in stabilizing vessel 30 and gaskets 42, 44, which are sized and shaped to receive fasteners 40. The holes 52 are spaced such that they align with the holes 48 of the top gasket 44, the holes 46 of the bottom gasket 42, and the holes 38 of the stabilizing vessel 30 when the top cap 50 is aligned properly. Top cap 50 is preferably thin from top to bottom, as it will extend above the vinyl liner 14 at the bottom 12 of the swimming pool 10, but should be thick enough to ensure that the gaskets 42, 44 will remain secured once the anchor arrangement 22 is installed.

Figure 4:
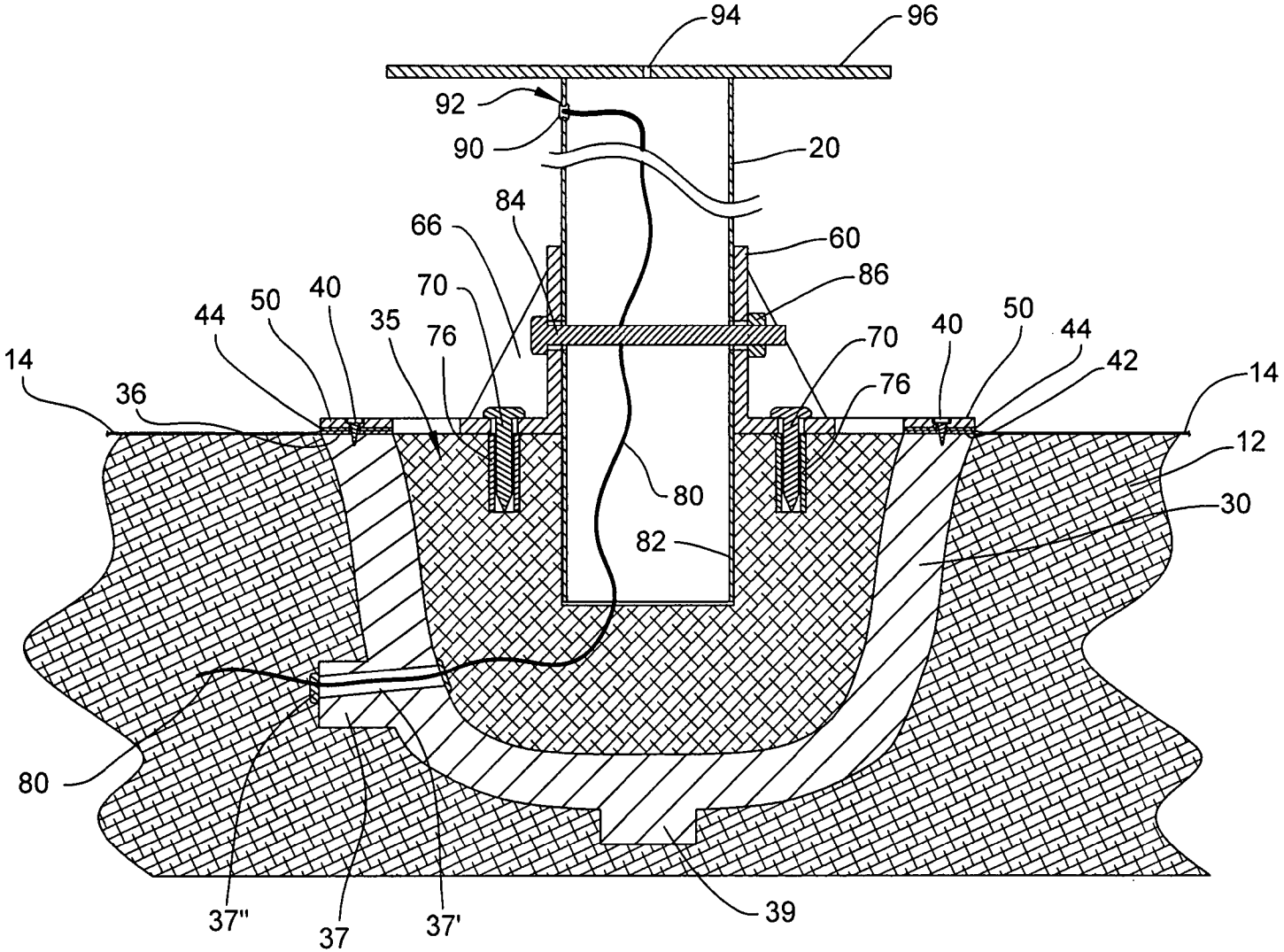
FIG. 4 is an elevational cross-section view of an installed anchor arrangement embodiment of the present invention.

The anchor arrangement 22 includes additional components, as shown in FIG. 3. These components include, among other things, a top deck anchor 60. The top deck anchor 60 has a substantially circular base 62 and a generally cylindrical central column 64 extending upwardly therefrom. The column 64 is hollow creating an inner substantially cylindrical space therein, and has an inner diameter that is minimally larger than the outer diameter of the post 20 to be installed. The top deck anchor 60 also includes a plurality of buttresses 66 which extend outwardly from the column 64 and upwardly from the base 62 to provide added strength and stabilization to the top deck anchor 60. The top deck anchor 60 as shown includes fixing apertures 68 in the base 62 which are equally spaced from one another and are each sized to receive a concrete setting screw 70. The top deck anchor 60 also has two side holes 72 bored horizontally through the column 64 for receiving set screws or an elongated fastener such as a bolt for securing a post to the top deck anchor 60. (See FIG. 4). Anchor arrangement 22 also includes, in addition to concrete setting screws 70, washers 74 and concrete sets 76. The concrete sets 76 contain internal threading for receiving the threaded portion of the concrete setting screws 70. The anchor arrangement 22 also includes a cylindrical sleeve 78 which preferably has the same outer diameter, or slightly larger diameter, than the post to be installed.

In operation, the anchor arrangement 22 is installed as follows. The concrete strip 13 of the bottom 12 of the swimming pool 10 is poured and while the concrete is still wet, the stabilizing vessel 30 for each post to be installed is inserted into the concrete such that the rim 36 of the stabilizing vessel 30 is substantially flush with the top surface of the concrete strip 13. A bonding wire 80 is threaded through the sealing nut 37" and side cleat aperture 37' of the wall 34 and extended upwardly out of and above stabilizing vessel 30. Sealing nut 37" is sealed around bonding wire 80 and inside cleat aperture 37' to ensure no seepage of water into the stabilizing vessel 30. Wet concrete is poured into the interior 35 of the stabilizing vessel 30 such that the top of the concrete in the interior 35 of the stabilizing vessel 30 is substantially flush with both the rim 36 and the top surface of the bottom 12 of the swimming pool 10. Bonding wire 80 protrudes out of the concrete in the interior 35 of the stabilizing vessel 30.

After the concrete is poured into the interior 35 of the stabilizing vessel 30, while such concrete is still wet, the center of the circle that is created by the rim 36 is determined and sleeve 78 is inserted into the wet concrete at that center, after the outer surfaces of sleeve 78 have been greased. The sleeve 78 should extend above the concrete a short amount, preferably at least two inches, and the top of the sleeve 78 is preferably level with the top of the top deck anchor 60 to allow easier installation and leveling. The top deck anchor 60 is then placed downwardly over the sleeve 78 until its bottom contacts the top surface of the concrete in the interior 35 of the stabilizing vessel 30. Using the fixing apertures 68 in the top deck anchor 60 as guides, the concrete sets 76 are inserted into the wet concrete. The top lip of the concrete sets 76 should be substantially flush with the top surface of the concrete in the interior 35 of the stabilizing vessel 30. The concrete is allowed to dry. Once the concrete is dried, the fasteners 70 are removed. The top deck anchor is then removed by pulling it upwardly away from the concrete and sleeve 78.

The greased sleeve 78 is then removed, leaving a cylindrically-shaped ring and a concrete plug in the center of the circle created by the rim 36. The plug is then removed, such as by chiseling, creating a hole 82. The bottom gasket 42 is placed on the rim 36, with holes 46 aligned with holes 38. The vinyl liner 14 is then installed over the bottom 12 of the swimming pool 10, including over the bottom gasket 42, the rim 36, and the hole 82. The vinyl liner 14 is then sealed to the anchor arrangement 22 by placing top gasket 44 over the vinyl liner 14 at a position directly above bottom gasket 42. The holes 48 of the top gasket 44 are aligned with the holes 46 of the bottom gasket 42 and the holes 38 in the rim 36 of the stabilizing vessel 30. The top cap 50 is placed on top of the top gasket 44 with the holes 52 aligned with holes 48, 46, and 38. Fasteners 40 are inserted through the holes 52, 48, and 46 and into the holes 38 of the rim 36. The fasteners 40 are tightened to create a watertight seal between the top cap 50 and the rim 36 of the stabilizing vessel 30.

The top deck anchor 60 is then placed over the hole 82 and over the concrete sets 76. Each fixing aperture 68 is aligned with a concrete set 76 and a concrete setting screw 70 is inserted through each fixing aperture 68 and into a concrete set 76. The screws 70 are each fastened to a respective concrete set 76, but not completely tightened.

The support post 20 is positioned adjacent the anchor arrangement 22 and the bonding wire 80 is strung through the support post 20, extending toward the top of the support post 20 to a grounding bug 90, which is preferably inserted in a 10/32" threaded bore 92 in the support post 20. If a stool is being installed, a hole 94 is preferably bored into a seat plate 96 to allow access to the grounding bug 90 for attachment of bonding wire 80. The bottom of the support post 20 is then inserted through the top deck anchor 60 and into the hole 82. After the bottom of support post 20 contacts the bottom of hole 82, a bolt 84 is inserted through the first side hole 72 in the top deck anchor 60, through post 20, and through the second side hole 72. A nut 86 is used to tighten the bolt 84 and secure the support post 20 to the top deck anchor 60. The concrete setting screws 70 are then tightened, completing the secure fastening of the support post 20 to the bottom 12 of the swimming pool 10. A stool seat, or other desired apparatus may then be attached to the secured support post 20.

The above-described anchor assembly embodiment and method of use of the anchor assembly provide a sturdy, stable, and easy-to-use system for affixing a post to the bottom of a vinyl-lined swimming pool. The system provides enough stability such that the post will not come loose or be damaged without a force that is atypical of that found in a standard swimming pool. Moreover, the anchor assembly provides a watertight assembly such that water will not seep between the vinyl liner and the bottom of the pool.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A post anchor kit for a swimming pool, the post anchor kit comprising:

a receptacle having a bottom, at least one side wall extending from the bottom, the bottom and side wall together defining an interior receptacle space, the side wall terminating at a top rim;

a first gasket for assisting in sealing the post anchor from water leakage when installed;

a second gasket for assisting in sealing the post anchor from water leakage when installed;

a top ring for engagement with the second gasket and for securing the first gasket and the second gasket to the top rim of the receptacle; and a top deck anchor that is attachable to a post and attachable to the receptacle or to a material within the interior receptacle space.

2. The post anchor kit of claim 1, wherein the top deck anchor comprises a generally cylindrical column having a substantially cylindrical space therein.

3. The post anchor kit of claim 1, wherein the receptacle includes a bore therein sized and disposed to receive a bonding wire.

4. The post anchor kit of claim 1, wherein the receptacle comprises at least one cleat extending from one of the bottom and the side wall.

5. The post anchor kit of claim 1, and further including a plurality of concrete sets.

6. The post anchor kit of claim 1, and further including at least one fastener for attaching the top deck anchor to a post or other installed item.

7. An installed swimming pool apparatus comprising:

a receptacle having a bottom, at least one side wall extending upwardly from the bottom, the bottom and side wall together defining an interior receptacle space, the side wall defining a top rim;

a first gasket for assisting in sealing the apparatus from water leakage when installed, the first gasket having the same general horizontal cross-sectional shape as the top rim and positioned above the top rim;

a second gasket for assisting in sealing the apparatus from water leakage when installed, the second gasket having the same general horizontal cross-sectional shape as the top rim and positioned above the first gasket;

a top cap positioned above the second gasket and attached to the receptacle to secure the first gasket to the receptacle and the second gasket to the first gasket; and a top deck anchor having a cavity therein capable of receiving a apparatus, the top deck anchor being attachable to a bottom of a swimming pool.

8. The swimming pool apparatus of claim 7, wherein the receptacle has a substance therein to which the top deck anchor is attached, the substance being capable of receiving a post.

9. The swimming pool apparatus of claim 7, wherein the top deck anchor comprises a base and a column extending from the base, the column capable of being attached to a post.

10. The swimming pool apparatus of claim 7, wherein the receptacle has an aperture through one of the bottom and the side wall, the aperture configured to receive a bonding wire therein.

11. The swimming pool apparatus of claim 10, wherein the receptacle comprises at least one cleat thereon, and the aperture extends through the cleat.

12. The swimming pool apparatus of claim 9, the column having at least one hole therein for receiving a fastener for attachment of the top deck anchor to a post.

13. A method of installing an object in a swimming pool, the method comprising the steps of:

(a) providing a open area configured to have a swimming pool installed therein;

(b) providing an object for installation in a swimming pool;

(c) installing the bottom of a swimming pool in the open area, the bottom having at least one cavity therein;

(d) inserting a receptacle into the cavity and securing the receptacle to the bottom of the swimming pool, the receptacle having a receptacle bottom and at least one side wall extending upwardly therefrom, the side wall terminating in a top rim, the receptacle bottom and side wall defining a receptacle interior;

(e) inserting a substance into the receptacle interior, the substance having at least one interior cavity therein;

(f) attaching a top deck anchor to the substance within the receptacle interior;

(g) placing a first gasket over the top rim of the receptacle;

(h) lining the bottom of the swimming pool with a liner, the liner extending over the first gasket;

(i) placing a second gasket over the liner and the first gasket;

(j) placing a top cap over the second gasket, and attaching the top cap, the first gasket, the second gasket, and the receptacle together to secure the liner between the first gasket and the second gasket;

(k) inserting the object into the interior cavity in the substance; and (l) attaching the object to the top deck anchor.

14. The method of claim 13, wherein the receptacle side wall has at least one aperture therein for securing the top cap to the receptacle.

15. The method of claim 13, wherein the top deck anchor has an anchor aperture and the step of attaching the object to the top deck anchor includes inserting the object into the anchor aperture.

16. The method of claim 13, wherein the substance comprises concrete.

17. The method of claim 13, wherein the object comprises a post.

18. The method of claim 13, wherein the receptacle has at least one cleat thereon for assisting in stabilization of the receptacle in the floor of the swimming pool.

* * * * *